US005392589A

United States Patent [19]

Buchanan

[11] Patent Number: 5,392,589

[45] Date of Patent: Feb. 28, 1995

[54] METHOD OF CONSTRUCTING A CONTAINER WITH UNITARY SPOUT PULL TAB

[75] Inventor: Jerry E. Buchanan, Alpharetta, Ga.

[73] Assignee: Jebco Packaging Systems, Inc., Tucker, Ga.

[21] Appl. No.: 115,646

[22] Filed: Sep. 3, 1993

[51] Int. Cl.[6] ..... B65D 5/70; B65B 61/18

[52] U.S. Cl. ..... 53/412; 53/133.7; 53/456; 229/125.17; 229/160.2; 229/249; 493/87; 493/212; 493/963

[58] Field of Search ..... 53/412, 456, 455, 452, 53/133.7, 133.3, 133.8, 133.5; 493/963, 212, 87, 165; 229/160.2, 125.42, 249

[56] References Cited

U.S. PATENT DOCUMENTS

| | | | |
|---|---|---|---|
| 3,074,610 | 1/1963 | Pugh | 229/7 |
| 3,178,090 | 4/1965 | Connell | 229/160.2 X |
| 3,327,925 | 6/1967 | Coker | 229/62.5 |
| 3,348,755 | 10/1967 | MacEwen | 229/17 |
| 3,520,464 | 7/1970 | Pugh, Sr. | 229/17 |
| 4,611,753 | 9/1986 | Kullberg | 229/125.42 X |
| 4,714,164 | 12/1987 | Bachner | 229/249 X |
| 4,789,066 | 12/1988 | Lisiecki | 229/125.42 X |
| 4,874,126 | 10/1989 | Miller | 229/160.2 |
| 4,883,222 | 11/1989 | Fujisawa | 229/160.2 |
| 4,884,695 | 12/1989 | Kjelgaard | 229/249 |
| 4,946,041 | 8/1990 | Poole | 236/621.1 |
| 5,029,752 | 7/1991 | Andersson | 229/160.2 |
| 5,060,803 | 10/1991 | Beer et al. | 206/610 |

FOREIGN PATENT DOCUMENTS

| | | | |
|---|---|---|---|
| 4189744 | 7/1992 | Japan | 229/160.2 |

*Primary Examiner*—James F. Coan
*Attorney, Agent, or Firm*—Kennedy & Kennedy

[57] ABSTRACT

A method of making a container (10) having a unitary spout pull tab from a continuous sheet of flexible material (11) comprises the steps of folding the sheet to form two opposite side walls (23) joined at a bottom end by a bottom wall (20) and open at a top end opposite the bottom wall. Elongated portions of the two side walls are sealed together along their side edges to form two side seals (27) at least one of which includes a tab portion (12). Two breachably sealed V-folds (33, 34) are formed in the side walls adjacent the top end straddling the tab portion of the one side seal. Upon manually pulling the tab portion of the one side seal, the breachable seals of the V-folds straddling the tab portion of the one side seal may be broken and the two V-folds pulled outwardly to collectively form an open spout (S).

14 Claims, 4 Drawing Sheets

METHOD OF CONSTRUCTING A CONTAINER WITH UNITARY SPOUT PULL TAB

TECHNICAL FIELD

The present invention relates to methods of making flexible containers, and particularly to methods of making flexible containers of the type that have a breachable seam that may be manually separated by pulling a pull tab to form an open spout.

BACKGROUND OF THE INVENTION

Today, containers such as milk and juice cartons exist that are made from sheets of flexible materials such as plastics and cardboard. Commonly, cardboard constructed cartons have gabled tops. At a top edge of the carton, side walls fold inwardly forming a V-fold which lies between front and rear sides of the container. The container is sealed along this top edge thermally or with an adhesive to form two double wall flaps. The conventional method of opening such a container is to spread apart the flaps on one side and pull open at their center to separate their double wall and thereby form a V-shaped spout.

The breachable seal of the just described container is fairly strong to prevent accidental breaching which consumers often find difficult to break open. Many times when the consumer opens such a container, tearing occurs causing damage or fraying of the spout edges. This in turn makes it difficult to pour out the contents in a well defined stream.

To avoid this problem, various types of containers have tab opening means. One example is illustrated in U.S. Pat. No. 4,883,222 which discloses a tensile force tab attached to a leading edge of a container that utilizes simple linear pulling force to break its center seal to form a pouring spout. The tab is an integral piece that is either attached to or folded within the container leading edge. As another example, U.S. Pat. No. 4,874,126 discloses a manual grasping element such as a pull ring that is secured by a cord attached to a central apex of a carton side with a reinforced adhesive strip. A consumer pulls the ring away from the central apex to open this type container.

In the just described containers the tab is a discrete structure that is attached in some manner to the carton body. If such structural bifurcation and independency could be avoided with its attendant cost of manufacture, and a method of constructing a carton with unitary tab devised, a distinctive advance could be achieved in the art. Therefore, it is to the provision of such a method that the present invention is primarily directed.

SUMMARY OF THE INVENTION

Briefly described, the present invention relates to a method of constructing a container with a unitary spout pull tab from a sheet of flexible material comprising the steps of folding the sheet to form two opposite side walls joined at a bottom end by a bottom wall and open at a top end opposite the bottom wall. Elongated portions of the two side walls are sealed together along their side edges to form two side seals at least one of which includes a tab portion. Two breachably sealed V-folds are formed in the side walls adjacent the top end straddling the tab portion of the one side seal. So constructed, upon manually pulling the tab portion of the one side seal, the breachable seals of the V-folds straddling the tab portion of the side seal may be broken and the two V-folds pulled outwardly to collectively form an open spout.

DETAILED DESCRIPTION

Figure 1:
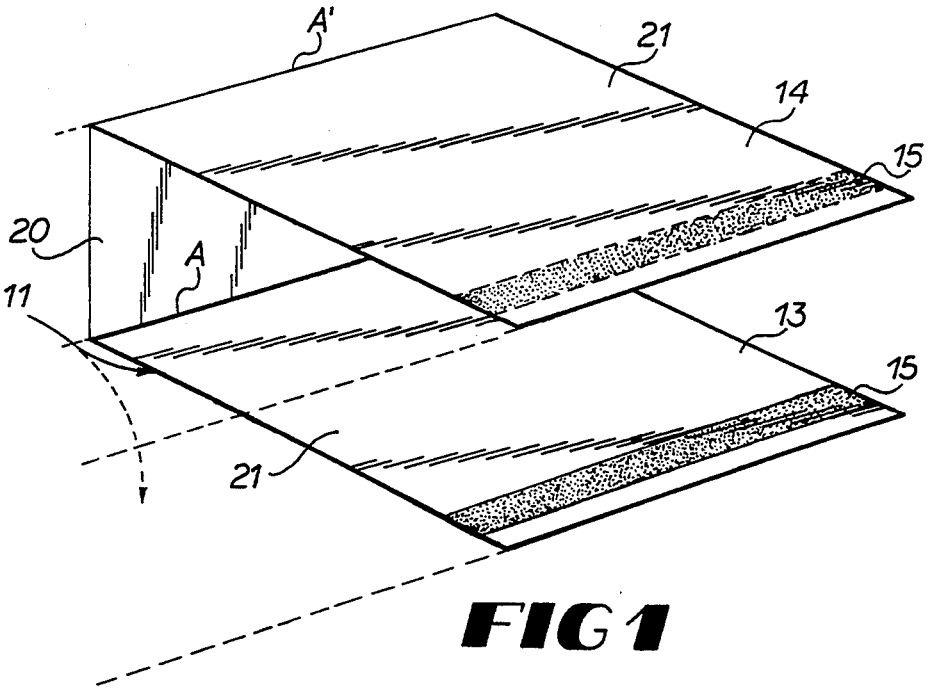
FIGS. 1–7 are perspective views of a portion of a continuous sheet of flexible material in progressive stages of the production of a container body with a tab formed as a unitary element in accordance with principles of the invention in a preferred form.
Figure 2:
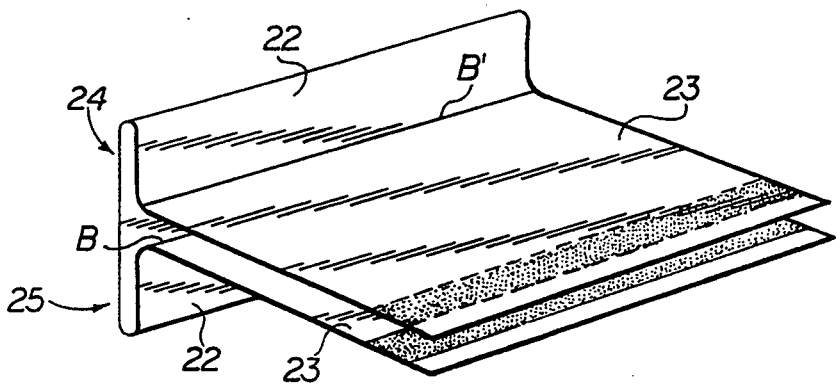

Referring now in more detail to the drawing, there is shown in FIGS. 1–7 a preferred method of forming a container 10 made from a continuous sheet 11 of flexible material with a unitary spout pull tab 12. In FIG. 1 a sheet 11 of flexible material having an inner layer of thermally bondable polyethylene 13 and an outer layer of strong, relatively non-thermally bondable nylon such as polyester 14 is used for construction of the container. The two lightly stippled strips 15 represent areas of weaker thermally bondable material than the rest of the insides. This sheet 11 first is folded along two parallel, linear folds A and A′ to form a central portion 20 straddled by two end portions 21. The sheet 11 is then formed into the shape of a T by folding the end portions 21 along two parallel, linear folds B and B′ oriented parallel with folds A and A′ to form two wing portions 22 that overlay the central portion 20. In doing this folds A and A′ are further folded in bringing the wing portions 22 to positions overlaying the central portion 20. The remaining two portions of the former end portions 21 are now referred to as side wall portions 23. The overlaying wing portions 22 and center portions 20 together now form two coplanar pleats 24 and 25.

Figure 3:
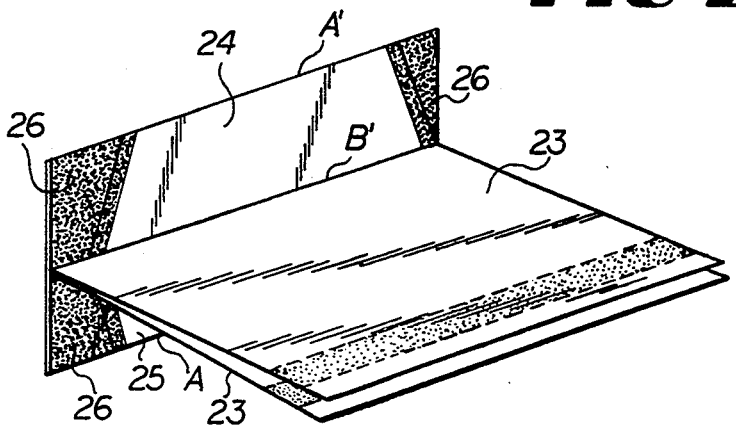
Figure 4:
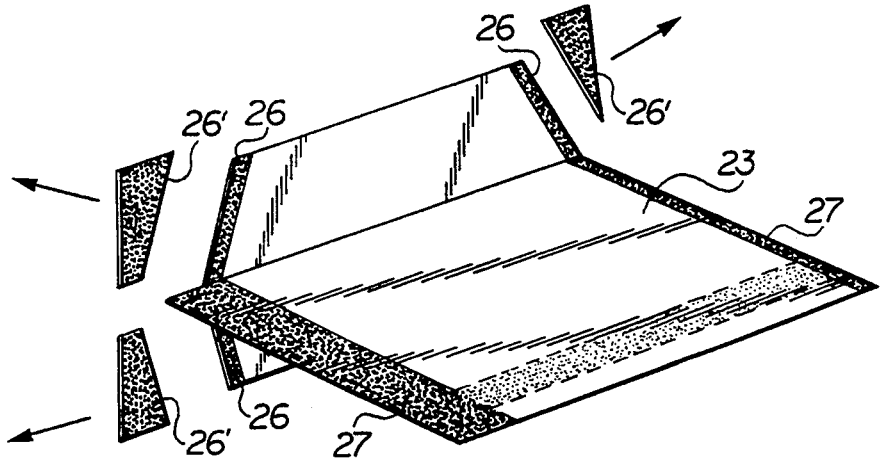
Figure 5:
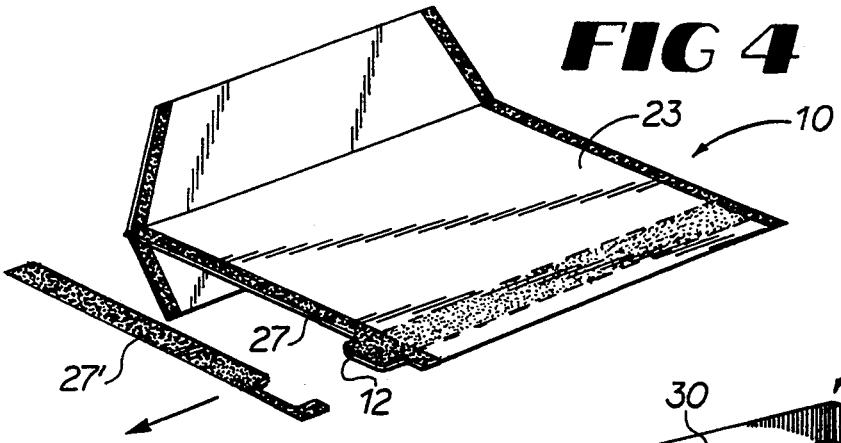

As shown by heavy stippling in FIG. 3 seals 26 are next thermally formed between corner sections of the overlaying materials of the pleats 24 and 25. Note that edges of these seals extend diagonally between folds A, A′ and B, B′. Portions 26′ of these seals are now cut off and discarded as shown in FIG. 4. Here also it is seen that elongated side seals 27 are thermally formed along outside portions of the two overlapping side wall portions 23 which extend normally from seals 26. Note also that one side seal 27 has a width about the same as that of coexistence seals 26. The other side seal 27 however is wider, it having a width about the same as coexistence 26 prior to its excess portion 26′ having been removed. Most but not all of the larger part of the larger side seal 27 is next removed as shown at 27′ in FIG. 5 whereupon the remaining section of that side seal includes a unitary pull tab 12. The structure is now in the form of a collapsed container 10 with sealed sides and bottom.

Figure 6:
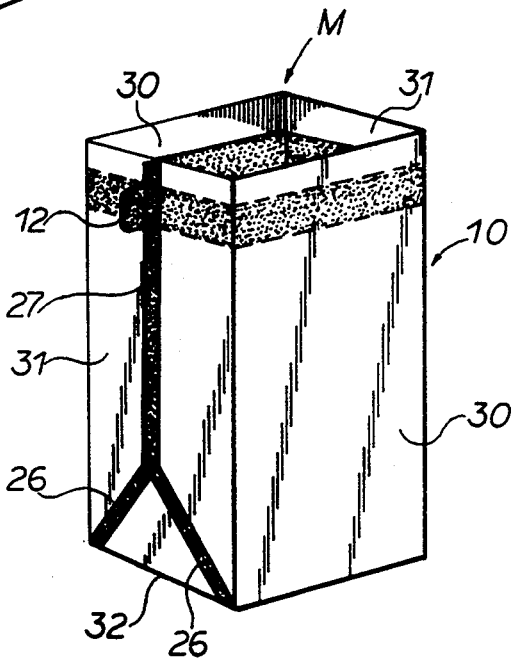

Next the structure is oriented uprightly and its side wall portions 23 spread apart causing the structure to assume the shape shown in FIG. 6 of an open top container 10. For clarity of illustration it is shown as a well defined parallelpiped structure with four distinct side corners. This may, of course be done by distinct folds. However, these side corners may be curved and indistinct. In any event its box-like or carton-like configuration is maintained by now filling it with a measure of liquid or granular material M. It now is an open top container 10 having two opposite side walls 30, two opposite end walls 31, a bottom 32 and the spout pull tab 12 all of unitary material structure made from the sheet 11.

Figure 7:
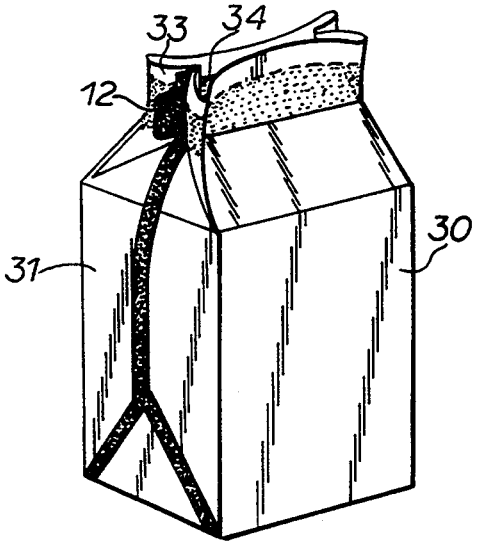

Finally, the top of the container is sealed closed as shown in FIG. 7. This is done by folding an upper portion of the end walls 31 inwardly to bring the two lightly stippled areas into flush contact. Two end V-folds are formed in the upper regions of the end walls 31 by double wall portions 33 and 34. On one end it is seen that pull tab 12 has been preferably formed of a size sufficiently to extend outwardly from these wall portions 33, 34 so that it is easily accessible. The lightly stippled areas in flush contact are then thermally bonded. This causes the two members of each V fold to be sealed as well as the top of the container extending between the V-folds in the end walls. Since they are only on the inside of the material, the wall portions 33 and 34 are not bonded together.

Figure 8:
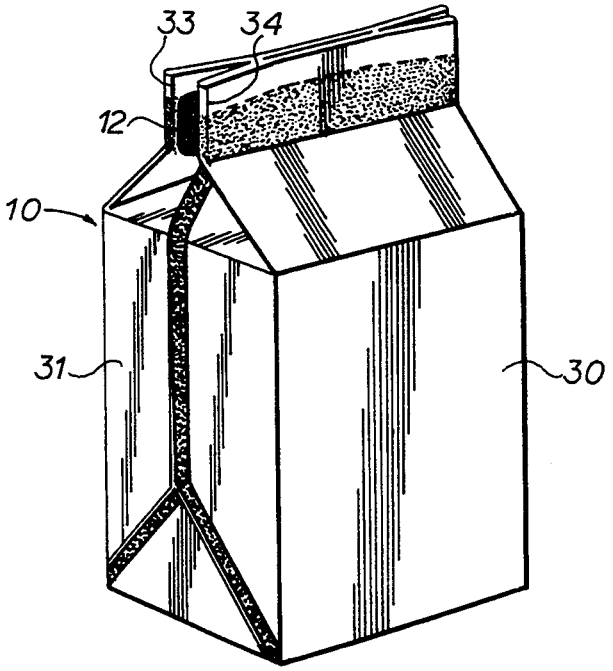
FIG. 8 is a perspective view of a completed container produced in accordance with the method of construction illustrated in FIGS. 1–7.
Figure 9:
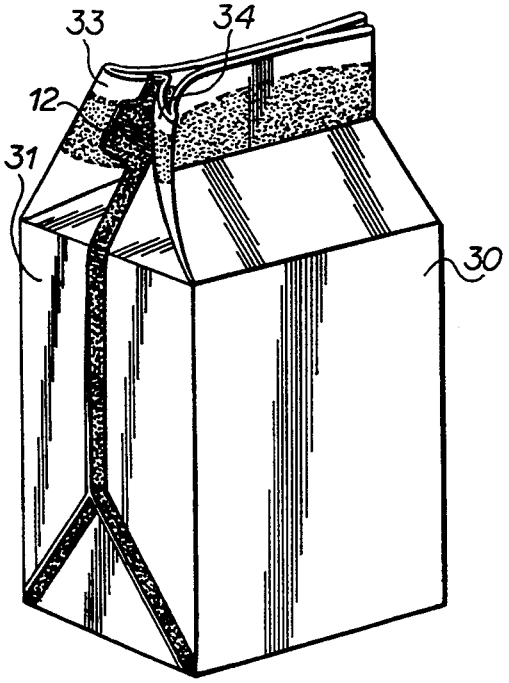
FIG. 9 is another perspective view of the container with its top seal partially breached in manually reconfiguring it with an open top spout.
Figure 10:
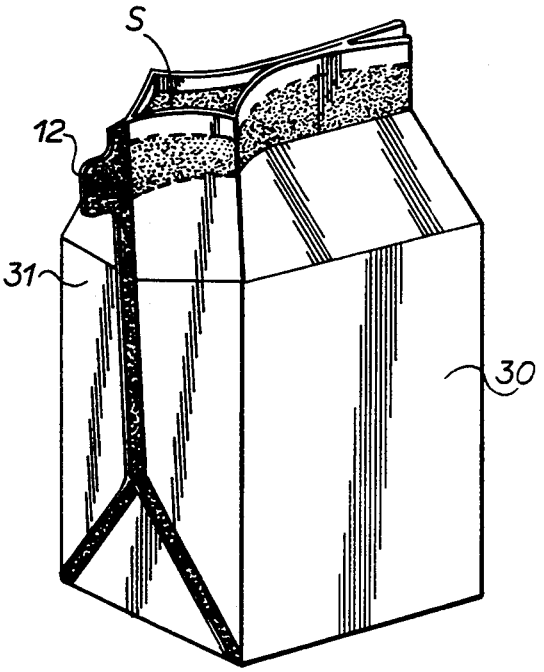
FIG. 10 shows the container with its pouring spout fully formed.

The manner by which the container may be manually opened is shown in FIGS. 8–10. In FIG. 8 it is shown in its sealed condition. To open it and thereby form a spout S one simply grips the pull tab 12 between thumb and finger and pulls outwardly. In doing this the wall portions 33 and 34 about the tab 12 are often spread by the fingers as shown in FIG. 9. This causes the lightly bonded together regions of the top V-folds in the end wall straddling the pull tab to separate thereby forming a open spout S in the top of the container as the elements of each V-fold assume an obtuse angle, shown in FIG. 10. Contents of the container may now be poured out of it and the spout S closed by folding the folds inward.

Figure 12:
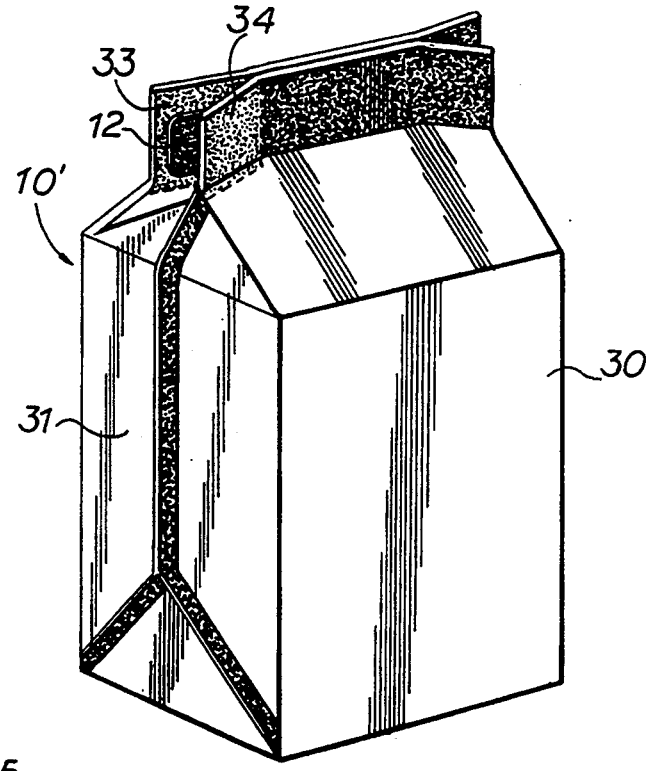
FIG. 12 is an assembled view, in perspective, of the container of FIG. 11.
Figure 11:
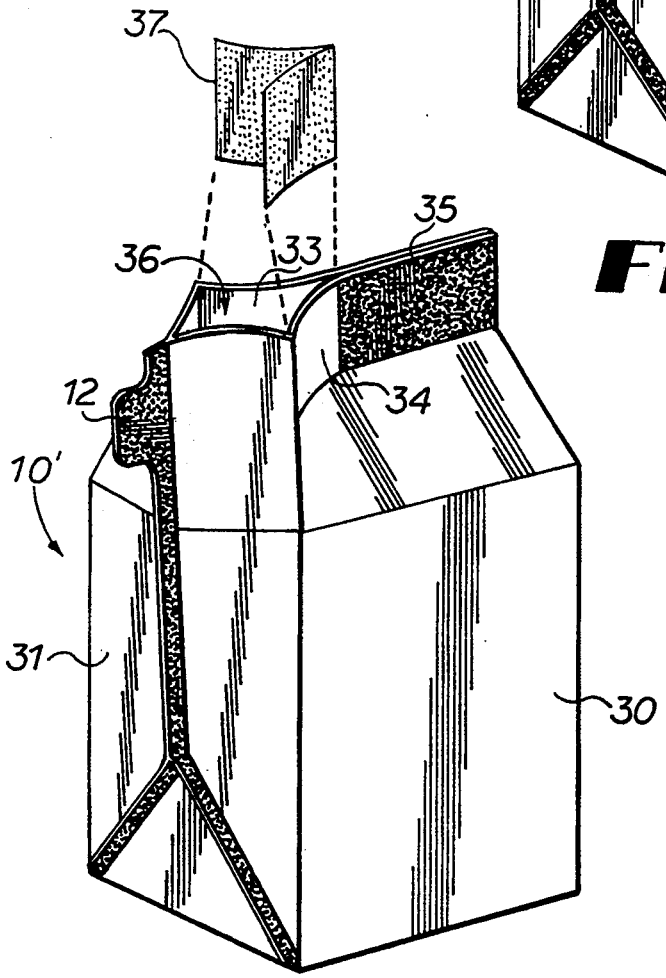
FIG. 11 is an exploded view in perspective of a container with unitary spout opening tab constructed by a method that embodies principles of the invention in another preferred form.

In another preferred form of the invention, as shown in FIGS. 11 and 12, the container 10' here is made from a sheet of flexible material 11 but without the strips 15 of weaker bonding strength. As shown in FIG. 11, the top of the container 10' is only partially sealed after filling by folding the upper portion of the other end wall 31 that is not formed with the spout pull tab 12. This portion is then thermally bonded forming a strong bond as represented by heavy stippling 35. The material bounding the open spout area 36 is contacted with a lightly thermally bonded insert 37 placed flushly thereagainst. To complete the sealing of the top of the container 10' the upper portion of the end wall 31 with pull tab is folded inward to form double wall portions 33, 34 and thermally bonded as represented in light stippling in FIG. 12. The spout pull tab 12 extends outwardly from these double wall portions 33, 34. The container spout is opened and closed in the same manner as disclosed with reference to FIGS. 8–10. The lightly bonded areas of the insert 37 are easily broken to open the top of the container but remains adhered to the wall portions 33, 34 so as not to fall within the container as the spout is formed.

It thus is seen that a container made of a sheet of flexible material is now provided with a spout pull tab that is unitary with the container itself rather than as an ancillary, attached piece. While this invention has been described in detail with particular reference to the preferred embodiments thereof, it should be understood that many modifications, additions and deletions may be made thereto without departure from the spirit and scope of the invention as set forth in the following claims.

I claim:

1. A method of constructing a container with a unitary spout pull tab from a sheet of flexible material that comprises the steps of (a) folding the sheet to form two opposite side walls joined at a bottom end by a bottom wall and open at a top end opposite the bottom wall, (b) sealing together elongated portions of the two side walls along their side edges to form two side seals at least one of which includes a tab portion, and (c) forming two breachably sealed V-folds in the side walls adjacent the top end straddling the tab portion of the one side seal, whereby upon manually pulling the tab portion of the one side seal the breachable seals of the V-folds straddling the tab portion of the one side seal may be broken and the two V-folds pulled outwardly to collectively form an open spout.

2. The method of claim 1 wherein between steps (b) and (c) the container is filled with a substance causing portions of the two opposite side walls to form two opposite end walls with one end wall having the tab portion extending therefrom.

3. The method of claim 1 in which after step (b) a section of one of the side seals is cut away in a pattern such that the tab portion is formed as a defined structure.

4. The method of claim 3 in which the tab portion protrudes from between the two sealed V-folds in the side wall.

5. The method of claim 1 in which the bottom wall has two side seals, each coextensive with and normal to its corresponding adjacent side wall side seals.

6. The method of claim 1 in which prior to forming the breachably sealed V-folds a low adhesive material film component being at least the width of the sealed V-folds is inserted adjacent the tab portion and bonded to the V-folds.

7. A container produced in accordance with the method of claim 1.

8. A method of making a container from flexible fusible material having a breachable seam with a pull tab extension comprising the steps of:

forming the material into an intermediate structure having a front subsection having an upper edge and a lower edge, a rear subsection underlying the front subsection having an upper edge and a lower edge, and a pre-formed bottom subsection;

placing on the intermediate structure a first side edge seal connecting the upper edges with the lower edges to bond the front subsection to the rear subsection with said first side edge seal having an outwardly extending portion adjacent the upper edges of the intermediate structure to form a tab extension;

placing on the intermediate structure a second side edge seal connecting the upper edges with the lower edges to bond the front subsection to the rear subsection, the second side edge seal being a distance from the first side edge seal;

forming a first side edge V-fold adjacent the upper edge of the front and rear subsections and extending from the upper edge to below the tab extension by tucking inward the first side edge seal;

forming a second side edge V-fold adjacent the upper edge of the front and rear subsections and extending from the upper edge to below the tab extension by tucking inward said second side edge seal;

placing on the intermediate structure along at least the width of the tab extension a top edge seal connecting the upper edges of the front and rear subsections and connecting the V-fold side edges of the front and rear subsections;

whereby upon pulling the tab extension the top edge seal is separated along the first side edge V-fold extending outward to form a spout.

9. The method of claim 8 whereby the tab extension extends beyond the first side edge V-fold.

10. The method of claim 8 whereby the tab extension is concealed within the first side edge V-fold.

11. The method of claim 8 in which the top edge seal is formed having a low adhesive sealing surface mounted on the inside container area of the first side edge V-fold to allow for easy opening when the adjacent tab extension is pulled.

12. The method of claim 11 whereby prior to forming the material into the intermediate structure the low adhesive sealing surface is laminated onto the material along the inside upper edge of the front and rear subsection as a strip the width of the top edge seal.

13. The method of claim 11 whereby prior to sealing the top of the container a low adhesive material film component being at least the width of the top edge seal is inserted adjacent the tab extension contacting the inside of the container along the first side edge V-fold.

14. A container produced in accordance with the method of claim 8.

* * * * *